US009758747B2

(12) United States Patent
Boutique et al.

(10) Patent No.: US 9,758,747 B2
(45) Date of Patent: Sep. 12, 2017

(54) EXTERNAL STRUCTURING SYSTEM FOR LIQUID LAUNDRY DETERGENT COMPOSITION

(75) Inventors: Jean-Pol Boutique, Gembloux (BE); Luc Marie Willy Lievens, Erpe-Mere (BE); Vincenzo Guida, Rome (IT); Frederik Vandenberghe, Gentbrugge (BE)

(73) Assignee: The Procter & Gamble Company, Cincinnati, OH (US)

( * ) Notice: Subject to any disclaimer, the term of this patent is extended or adjusted under 35 U.S.C. 154(b) by 207 days.

(21) Appl. No.: 12/881,276

(22) Filed: Sep. 14, 2010

(65) Prior Publication Data

US 2011/0065625 A1 Mar. 17, 2011

Related U.S. Application Data

(60) Provisional application No. 61/242,143, filed on Sep. 14, 2009.

(51) Int. Cl.

| | |
|---|---|
| ***C11D 17/00*** | (2006.01) |
| ***C11D 3/30*** | (2006.01) |
| ***C11D 3/382*** | (2006.01) |
| ***C11D 3/20*** | (2006.01) |

(52) U.S. Cl.

CPC ..... *C11D 3/30* (2013.01); *C11D 3/2093* (2013.01); *C11D 3/382* (2013.01); *C11D 17/0026* (2013.01)

(58) Field of Classification Search

CPC ..... C11D 3/30; C11D 3/2093; C11D 3/382; C11D 3/3409; C11D 17/00; C11D 17/0026

USPC ..... 510/276, 295, 296, 303, 336, 337

See application file for complete search history.

(56) References Cited

U.S. PATENT DOCUMENTS

| | | | | |
|---|---|---|---|---|
| 5,340,390 | A | 8/1994 | Magauran et al. | |
| 6,306,817 | B1 | 10/2001 | Kott et al. | |
| 6,514,926 | B1 | 2/2003 | Kott et al. | |
| 6,579,839 | B2 | 6/2003 | Price et al. | |
| 6,583,096 | B1 | 6/2003 | Kott | |
| 6,589,927 | B1 | 7/2003 | Kott | |
| 6,593,285 | B1 | 7/2003 | Scheibel et al. | |
| 6,602,840 | B1 | 8/2003 | Scheibel et al. | |
| 6,815,410 | B2 | 11/2004 | Boutique et al. | |
| 6,833,344 | B2 | 12/2004 | Boutique et al. | |
| 6,849,588 | B2 | 2/2005 | Elsik et al. | |
| 6,881,713 | B2 | 4/2005 | Sommerville-Robert | |
| 6,903,061 | B2 | 6/2005 | Masschelein et al. | |
| 7,125,828 | B2 | 10/2006 | Catlin et al. | |
| 7,479,475 | B2 | 1/2009 | de Buzzaccarini et al. | |
| 7,563,757 | B2 | 7/2009 | Kouvroukoglou et al. | |
| 7,910,535 | B2 | 3/2011 | Panandiker et al. | |
| 2003/0096726 | A1 | 5/2003 | Smith et al. | |
| 2003/0199414 | A1 | 10/2003 | Boutique et al. | |
| 2004/0009882 | A1* | 1/2004 | Elsik et al. | 510/108 |
| 2004/0058845 | A1* | 3/2004 | Metrot et al. | 510/466 |
| 2004/0200005 | A1 | 10/2004 | Smerznak et al. | |
| 2004/0226106 | A1 | 11/2004 | Gardner et al. | |
| 2005/0043200 | A1* | 2/2005 | Barry et al. | 510/421 |
| 2006/0003913 | A1 | 1/2006 | Boutique et al. | |
| 2006/0205631 | A1 | 9/2006 | Smerznak et al. | |
| 2006/0275566 | A1 | 12/2006 | de Buzzaccarini et al. | |
| 2006/0276364 | A1* | 12/2006 | Kouvroukoglou et al. | 510/293 |
| 2008/0004200 | A1 | 1/2008 | Boutique et al. | |
| 2008/0032909 | A1 | 2/2008 | de Buzzaccarini et al. | |
| 2009/0124528 | A1 | 5/2009 | Danzinger et al. | |
| 2009/0176682 | A1 | 7/2009 | Boutique et al. | |
| 2009/0298739 | A1* | 12/2009 | Courchay et al. | 510/357 |
| 2010/0240569 | A1 | 9/2010 | Boutique et al. | |
| 2010/0240571 | A1 | 9/2010 | Boutique et al. | |
| 2010/0249003 | A1 | 9/2010 | Doi et al. | |
| 2011/0065624 | A1 | 3/2011 | Boutique et al. | |
| 2011/0065625 | A1 | 3/2011 | Boutique et al. | |
| 2011/0312869 | A1 | 12/2011 | Danzinger et al. | |

FOREIGN PATENT DOCUMENTS

| | | | |
|---|---|---|---|
| WO | WO 2005/118430 | A1 | 12/2005 |
| WO | WO 2007/130562 | A2 | 11/2007 |
| WO | WO 2008/055121 | A2 | 5/2008 |
| WO | WO 2009/061990 | A1 | 5/2009 |
| WO | WO 2009/071709 | A1 | 6/2009 |

OTHER PUBLICATIONS

U.S. Appl. No. 12/881,365, filed Sep. 14, 2010, Boutique, et al.
International Search Report 9 Pages.

* cited by examiner

*Primary Examiner* — Amina Khan
(74) *Attorney, Agent, or Firm* — Gregory S. Darley-Emerson; Leonard W. Lewis; Steven W. Miller

(57) ABSTRACT

Liquid or gel-form detergents can be externally structured with a structuring system comprising crystallizable glyceride(s) emulsified with an alkanolamine-neutralized anionic surfactant. Crystallizable glyceride(s) of use include hydrogenated castor oil. The liquid or gel-form detergents may be packaged in unit dose form.

9 Claims, 3 Drawing Sheets

EXTERNAL STRUCTURING SYSTEM FOR LIQUID LAUNDRY DETERGENT COMPOSITION

CROSS-REFERENCE TO RELATED APPLICATIONS

This application claims priority under 35 USC §119(e) to U.S. Provisional Application Ser. No. 61/242,143, filed Sep. 14, 2009.

FIELD OF THE INVENTION

The present invention relates to external structuring system(s) (ESS) comprising crystallized triglycerides including, but not limited to crystallized hydrogenated castor oil (HCO). The present invention also relates to methods of making ESS, and to laundry detergent compositions in liquid or gel form comprising ESS.

BACKGROUND OF THE INVENTION

Liquid compositions, particularly aqueous detergent compositions comprising appreciable amounts of surfactants may be difficult to formulate, given their tendency to split into two or more phases, such as one or more surfactant-rich phases and a water-rich phase. Further technical difficulties may arise when particulate matter is to be suspended in surfactant-containing liquid compositions as the particulates may have a tendency to rise to the top or to settle to the bottom of the composition over time. Yet consumers delight in fluid detergents offering stabilized particulate materials which can deliver cleaning performance, fabric care benefits, appearance benefits, and/or visual or aesthetic cues. Full internal structuring through reliance upon the intrinsic structuring properties of highly concentrated surfactants is one approach that may be utilized to stabilize dispersed particulate materials. However, this approach may waste surfactant and can limit formulation flexibility. These and other associated technical difficulties may be overcome while maintaining consumer delight through the use of external structurants and systems comprising them.

Aqueous laundry detergent compositions which are stabilized through the use of external structuring system(s) (ESS) comprising hydroxyl-containing stabilizers have been described. Hydrogenated castor oil (HCO) is a non-limiting example of a useful hydroxyl-containing stabilizer. HCO may be formulated into laundry detergent compositions using sodium-neutralized linear alkylbenzenesulfonate (Na-LAS), a common laundry detergent anionic surfactant. It is believed that NaLAS acts as an emulsifier for the HCO structuring system. The acid form of LAS (HLAS) for use in such systems may be neutralized for example, with sodium hydroxide to form NaLAS. The structurant system may be prepared by forming, separately from the balance of the detergent composition, a melt of HCO in aqueous Na-neutralized LAS, which may then be stirred to form an emulsion of molten HCO. This emulsion may then be cooled to crystallize the HCO. Upon crystallization, an external structurant in the form of a premix may be yielded. The premix may then be added to the balance of a liquid laundry detergent composition in order to structure it. Alternatively, the structurant may be crystallized in-situ by mixing the molten emulsified HCO premix with the balance of the detergent composition and then cooling.

Liquid detergents, particularly liquid detergents with low water content, and detergents in gel form, may be desirable since they can be more sustainable than their more dilute counterparts. It has now been discovered that it may be undesirable to introduce inorganic ions such as alkali metal ions or more particularly Na-ions, into external structuring systems used to prepare liquid or gel-form surfactant-rich detergents having relatively low water and/or solvent content.

It has further, rather surprisingly been discovered that, even though the total amount of sodium introduced into a liquid or gel-form laundry detergent via an ESS is not large, e.g., up to about 4% by weight, changing the HCO emulsifier from a sodium-neutralized anionic surfactant form to an alkanolamine neutralized anionic surfactant form, especially a monoethanolamine (MEA) neutralized LAS form improves the visual appearance and/or phase stability and/or particulate matter carrying capacity, as measured by conventional rheology techniques, of both of the external structurant mix and of the finished liquid or gel-form laundry detergent.

SUMMARY OF THE INVENTION

In one embodiment an ESS is provided as a premix. The premix is a product of forming a melt of crystallizable glyceride(s) including, but not limited to HCO, in aqueous at least partially lower alkanolamine-neutralized, preferably monoethanolamine-neutralized LAS. The crystallizable glyceride(s) melt is in the form of an emulsion or microemulsion, with the LAS acting as an emulsifier for the crystallizable glyceride(s). For purposes of clarity, it should be understood that "alkanolamine neutralized" means that the counter-ion of the anionic surfactant LAS is the cationic form or cation form of the alkanolamine. This alkanolamine is not acting as a solvent or as a buffer. The emulsion is cooled to crystallize the glyceride(s). This yields an external structurant in the form of an alkanolamine-containing, sodium-free crystallizable glyceride(s) premix, which can be shipped as an article of commerce, or can be directly added to the balance of a liquid laundry detergent composition. The resulting detergent compositions are surprisingly more physically stable and/or capable of containing higher levels of total cleaning surfactant, and/or are more capable of structuring or suspending particles of any benefit agents, e.g., encapsulated bleaches, perfume microcapsules, mica etc., than is possible when otherwise comparable sodium-neutralized LAS-emulsified crystallizable glyceride(s) is used. The ESS compositions herein, in short, have improved thickening power over otherwise similar ESS made using sodium-neutralized LAS-emulsified crystallizable glyceride(s).

It is surprising and unexpected to find that a subtle change of counter-ion of the anionic surfactant, from NaLAS to MEA-LAS, so dramatically improves the rheology, physical structure and industrial utility of glyceride crystals that are formed in the premix and in the resulting detergent compositions.

In yet another aspect of the invention, use of the inventive ESS premixes leads to a combination of desirable formulation properties of the final detergent, and in-use properties of the detergent. This is occasioned by using the ESS to structure the detergent, permitting the formulator to focus on delivering highly soluble surfactants to the end user. In short, the invention de-couples formulation considerations (such as thickening and arriving at a stable product) from use considerations, e.g., highly soluble product, good cold water cleaning.

In some embodiments, the ESS of the present invention may comprise the following by weight percentage:

a. from about 2 to about 10% of crystals of a glyceride having a melting temperature of from 40° C. to 100° C.;
b. from about 2 to about 10% of an alkanolamine; and
c. from about 5 to about 50% of the anion of an anionic surfactant.

The alkanolamine is present in an amount at least balancing the charge of the anion form of said anionic surfactant and the structuring system is free from any added inorganic cations.

DETAILED DESCRIPTION OF THE INVENTION

Figure 1:
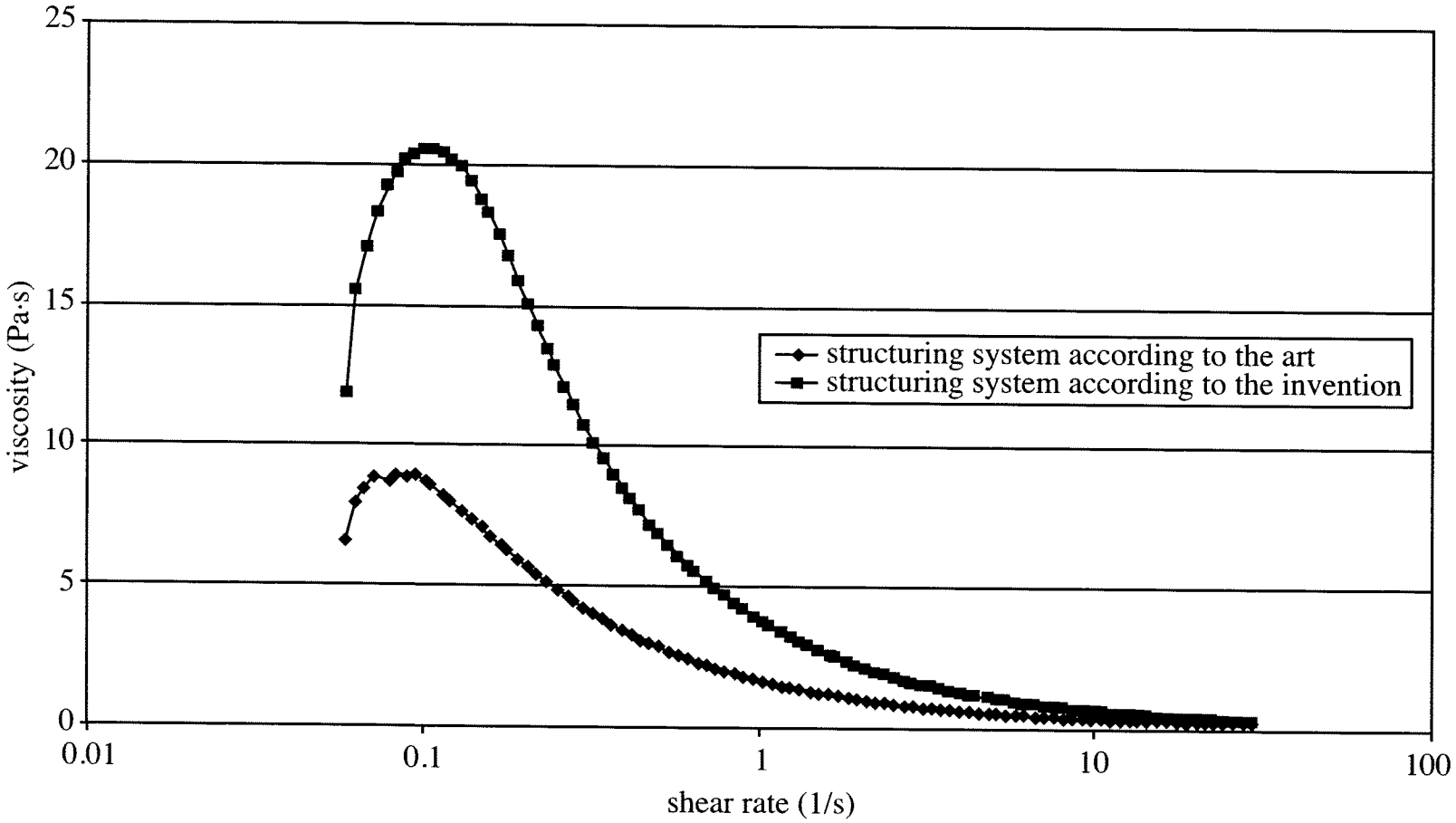
FIG. 1 is a plot comparison of viscosity vs. shear rate in the range of 0 to 30 $s^{-1}$.

As used herein, the term "external structuring system" or ESS refers to a selected compound or mixture of compounds which provide structure to a detergent composition independently from, or extrinsic from, any structuring effect of the detersive surfactants of the composition. Structuring benefits include arriving at yield stresses suitable for suspending particles having a wide range of sizes and densities. ESS of use may have chemical identities set out in detail hereinafter.

To be noted, the present ESS make use of currently known individual raw materials. No new chemical entities, .i.e., new chemical compounds, are produced. The invention relates to physical form modifications of the size and/or crystal habit of known chemical entities such as hydrogenated castor oil, and to processes associated therewith. Indeed, the avoidance of new chemical materials is one further advantage of the present invention.

Without wishing to be bound by theory, many external structurants are believed to operate by forming solid structures having particular morphologies in the detergent composition. These solid structures may take one or more physical forms. Non-limiting examples of typical physical or morphological forms include threads, needles, ribbons, rosettes and mixtures thereof. Without wishing to be bound by theory, it is believed that thread-like, ribbon-like, spindle-like or fibril-like structuring systems, that is to say structuring systems having non-spherical elongated particles, provide the most efficient structure in liquids. Consequently, in some embodiments, thread-like, ribbon-like, spindle-like or fibril-like structuring systems are preferred. It is further believed that external structurant systems comprising alkanolamine-neutralized, especially monoethanolamine-neutralized anionic surfactants, may contain, and provide in detergent compositions, a more complete fiber network than is present in an otherwise analogous composition in which a sodium neutralized anionic surfactant has been used, and may be more efficient in terms of surprisingly reducing the level of relatively poorly structuring spherical or rosette-like morphologies.

Further, in terms of underlying theory, but without intending to be limited thereby, the ESS systems of the invention possess higher thickening power than those wherein a sodium-neutralized anionic surfactant has been used, on account of the production therein of longer rod-like structures in the ESS as compared with the Na-anionic surfactant case. This is consistent with theory which predicts that the zero-shear viscosity of non-interacting hard rods in suspension scales with the third power of their length. See M. Doi, S. F. Edwards, Dynamics of rod-like macromolecules in concentrated solution, Part 1, Journal of Colloid Science 74 (1978) p. 560-570.

Further, in terms of underlying theory, but without intending to be limited thereby, the ESS systems of the invention provide higher yield stress or gel consistency at lower concentrations than do those involving Na-anionic surfactants. This is consistent with the theory which predicts that the minimum gel concentration scales with the inverse of length. See Bug, A. L. R.; Safran, S. A. Phys. Rev. 1986, 833, 4716. In simpler terms, in dispersions of objects in a solution, there exists a critical concentration, above which the system switches from a state having a number of discrete aggregates dispersed in the solution, to a state of forming a continuous network of aggregates. This transition causes the system to change from a viscoelastic liquid to a more "solid-like" gel. Above this threshold, the system starts to show a yield stress which is responsible for providing physical stabilization against macroscopic phase separation.

"Liquid" as used herein may include liquids, gels, foams, mousse, and any other flowable substantially non-gas phased composition. Non-limiting examples of fluids within the scope of this invention include light duty and heavy duty liquid detergent compositions, hard surface cleaning compositions, detergent gels commonly used for laundry, and bleach and laundry additives. Gases, e.g., suspended bubbles, may be included within the liquids.

"System" as used herein means a complex unity formed of many often, but not always, diverse parts (i.e., materials, compositions, devices, appliances, procedures, methods, conditions, etc.) subject to a common plan or serving a common purpose.

By "internal structuring" it is meant that the detergent surfactants, which form a major class of laundering ingredients, are relied on for structuring effect. The present invention, in the opposite sense, aims at "external structuring" meaning structuring which relies on a nonsurfactant, e.g., crystallized glyceride(s) including, but not limited to, hydrogenated castor oil, to achieve the desired rheology and particle suspending power.

"Limited solubility" as used herein means that no more than nine tenths of the formulated agent actually dissolves in the liquid composition. An advantage of crystallizable glyceride(s) such as hydrogenated castor oil as an external structurant is an extremely limited water solubility.

"Soluble" as used herein means that more than nine tenths of the formulated agent actually dissolves in the liquid composition at a temperature of 20° C.

"Premix" as used herein means a mixture of ingredients designed to be mixed with other ingredients, such as the balance of a liquid or gel-form laundry detergent, before marketing. A "premix" can itself be an article of commerce, and can be sold, for example in bulk containers, for later mixing with the balance of a laundry detergent at a remote location. One the other hand some premixes may directly be used for arriving at a complete detergent composition made in a single facility.

"Emulsion" as used herein, unless otherwise specifically indicated, refers to macroscopic droplets, which are large enough to be seen using conventional optical microscopy, of hydrogenated castor oil and/or another triglyceride, in the structurant premix (ESS). The emulsion can involve liquid droplets or can involve solidified droplets, depending on the temperature. Hydrogenated castor oil is soluble to a very limited extent of about 0.8% by weight in the alkanolamine neutralized anionic surfactant containing premix, and as a result, microemulsions may also be present. However, under microemulsion conditions, the payload of crystallizable glyceride(s) such as hydrogenated castor oil in the ESS declines. Therefore, emulsions of crystallizable glyceride(s) such as hydrogenated castor oil comprising droplets easily visible using light microscopy are preferred over microemulsions in the present invention on account of their superior payload efficiency. This may appear counter-intuitive, in view of the thought that larger droplets of hydrogenated castor oil might lead to loss of efficiency in structuring.

"Aspect ratio" as defined herein means the ratio of the largest dimension of a particle (1) to the smallest dimension of a particle (w), expressed as "1:w". An aspect ratio may for example characterize a structurant crystal particle of crystallizable glyceride(s) such as hydrogenated castor oil. The aspect ratio of dispersions can be adequately characterized by TEM (transmission electron microscopy) or similar techniques, e.g., cryo-ESEM. In using such techniques in the present invention, the intent is to examine crystals of the hydrogenated castor oil, or, more generally, any equivalently crystallizable glyceride; hence it is preferred to conduct measurements with a minimum of artifact creation. Artifacts can be created, for example, by evaporating solvent from the ESS so that surfactant crystals precipitate—these are not crystals of glyceride(s) such as hydrogenated castor oil for example. A high aspect ratio is desirable for the hydrogenated castor oil in the external structurants for use herein. Preferably the aspect ratio of crystals of hydrogenated castor oil in ESS and/or in detergents comprising is greater than 1:1, in other words the structurant crystals are elongated. In a preferred embodiment, the aspect ratio is at least 5:1. In a preferred embodiment the aspect ratio is from 5:1 to about 200:1, preferably from about 10:1 to about 100:1. In typical cases, the aspect ratio can be from 10:1 to 50:1.

"Needle Radius" as defined herein means the short dimension (w) of an elongated particle, for example a structurant crystal particle of crystallizable glyceride(s) such as hydrogenated castor oil for example. A typical needle radius of a crystallized glyceride in the ESS and in the final detergent composition is at least about 20 nanometers (nm). In some embodiments, the needle radius is from about 20 to about 500 nm, more preferably from about 20 to about 150 nm. In typical cases the needle radius can be from about 50 to about 100 nm.

"Rosette" as defined herein means a particle of crystallized structurant, e.g., of a glyceride such as hydrogenated castor oil for example, having a rosette-like appearance. Such particles can be readily seen by use of differential interference contrast microscopy, or other visual microscopy techniques. Rosettes can have an approximate diameter of 1-50 microns, more typically 2 to 20 microns, e.g., about 5 microns. Preferred ESS herein can be free from rosettes. Other preferred ESS herein may have a low proportion of rosettes to needle-like crystals. Without intending to be limited by theory, reducing the proportion of rosettes to needles improves the mass efficiency of the ESS.

The "Hydrophilic Index", ("HI") of an anionic surfactant herein is as defined in WO 00/27958A1 (Reddy et al.). Low HI synthetic anionic surfactants are preferred herein.

"Comprising" as used herein means that various components, ingredients or steps can that be conjointly employed in practicing the present invention. Accordingly, the term "comprising" encompasses the more restrictive terms "consisting essentially of" and "consisting of". The present compositions can comprise, consist essentially of, or consist of any of the required and optional elements disclosed herein.

As used herein, "essentially free" or "substantially free" of a component means that no amount of that component is deliberately incorporated into the composition.

Markush language as used herein encompasses mixtures of the individual Markush group members, unless otherwise indicated.

All percentages, ratios and proportions used herein are by weight percent of the composition, unless otherwise specified. All average values are calculated "by weight" of the composition or components thereof, unless otherwise expressly indicated.

All numerical ranges disclosed herein, are meant to encompass each individual number within the range and to encompass any combination of the disclosed upper and lower limits of the ranges.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

I. External Structuring System

The ESS of the present invention comprise: (a) crystallizable glyceride(s); (b) alkanolamine; (c) anionic surfactant; (d) additional components; and (e) optional components. Each of these components is discussed in detail below.

a. Crystallizable Glyceride(s)

Crystallizable glyceride(s) of use herein include "Hydrogenated castor oil" or "HCO". HCO as used herein most generally can be any hydrogenated castor oil, provided that it is capable of crystallizing in the ESS premix. Castor oils may include glycerides, especially triglycerides, comprising $C_{10}$ to $C_{22}$ alkyl or alkenyl moieties which incorporate a hydroxyl group. Hydrogenation of castor oil to make HCO converts double bonds, which may be present in the starting oil as ricinoleyl moieties, to convert ricinoleyl moieties to saturated hydroxyalkyl moieties, e.g., hydroxystearyl. The HCO herein may, in some embodiments, be selected from: trihydroxystearin; dihydroxystearin; and mixtures thereof. The HCO may be processed in any suitable starting form, including, but not limited those selected from solid, molten and mixtures thereof. HCO is typically present in the ESS of the present invention at a level of from about 2% to about 10%, from about 3% to about 8%, or from about 4% to about 6% by weight of the structuring system. In some embodiments, the corresponding percentage of hydrogenated castor oil delivered into a finished laundry detergent product is below about 1.0%, typically from 0.1% to 0.8%.

Useful HCO may have the following characteristics: a melting point of from about 40° C. to about 100° C., or from about 65° C. to about 95° C.; and/or Iodine value ranges of from 0 to about 5, from 0 to about 4, or from 0 to about 2.6. The melting point of HCO can measured using either ASTM D3418 or ISO 11357; both tests utilize DSC: Differential Scanning calorimetry.

HCO of use in the present invention includes those that are commercially available. Non-limiting examples of commercially available HCO of use in the present invention include: THIXCIN® from Rheox, Inc. Further examples of useful HCO may be found in U.S. Pat. No. 5,340,390. The source of the castor oil for hydrogenation to form HCO can be of any suitable origin, such as from Brazil or India. In one suitable embodiment, castor oil is hydrogenated using a precious metal, e.g., palladium catalyst, and the hydrogenation temperature and pressure are controlled to optimize hydrogenation of the double bonds of the native castor oil while avoiding unacceptable levels of dehydroxylation.

The invention is not intended to be directed only to the use of hydrogenated castor oil. Any other suitable crystallizable glyceride(s) may be used. In one example, the structurant is substantially pure triglyceride of 12-hydroxystearic acid. This molecule represents the pure form of a fully hydrogenated triglyceride of 12-hydroxy-9-cis-octadecenoic acid. In nature, the composition of castor oil is rather constant, but may vary somewhat. Likewise hydrogenation procedures may vary. Any other suitable equivalent materials, such as mixtures of triglycerides wherein at least 80% wt. is from castor oil, may be used. Exemplary equivalent materials comprise primarily, or consist essentially of, triglycerides; or comprise primarily, or consist essentially of, mixtures of diglycerides and triglycerides; or comprise primarily, or consist essentially of, mixtures of triglyerides with diglycerides and limited amounts, e.g., less than about 20% wt. of the glyceride mixtures, of monoglyerides; or comprise primarily, or consist essentially of, any of the foregoing glycerides with limited amounts, e.g., less than about 20% wt., of the corresponding acid hydrolysis product of any of said glycerides. A proviso in the above is that the major proportion, typically at least 80% wt, of any of said glycerides is chemically identical to glyceride of fully hydrogenated ricinoleic acid, i.e., glyceride of 12-hydroxystearic acid. It is for example well known in the art to modify hydrogenated castor oil such that in a given triglyceride, there will be two 12-hydroxystearic-moieties and one stearic moiety. Likewise it is envisioned that the hydrogenated castor oil may not be fully hydrogenated. In contrast, the invention excludes poly(oxyalkylated) castor oils when these fail the melting criteria.

Crystallizable glyceride(s) of use in the present invention may have a melting point of from about 40° C. to about 100° C.

b. Alkanolamine

Alkanolamine is an essential component the ESS of the present invention. Without wishing to be bound by theory, it is believed that alkanolamine reacts with the acid form anionic surfactant species to form an alkanolamine neutralized anionic surfactant. As such, alkanolamine can be introduced into the premix either by combining alkanolamine and acid-form anionic surfactant, e.g., HLAS in-situ in the premix, or by any other suitable means such as by separately neutralizing HLAS with alkanolamine and adding the neutral alkanolamine-LAS to the premix. However, in some embodiments it may be desirable that alkanolamine be present in the ESS of the invention in stoichiometric excess over the amount required to neutralize the acid form of the anionic surfactants. In such embodiments, the alkanolamine may serve the dual purpose of acting as part of the emulsifying surfactant and as a buffer. In some embodiments, the alkanolamine may be present at a level of from about 2% to about 10%, from about 3% to about 8%, or from about 3% to about 6% by weight of the structuring system. In some embodiments, the alkanoamine may be present at about 5% by weight of the structuring system.

In general, any suitable alkanolamine or mixture of alkanolamines may be of use in the present invention. Suitable alkanolamines may be selected from the lower alkanol mono-, di-, and trialkanolamines, such as monoethanolamine; diethanolamine or triethanolamine. Higher alkanolamines have higher molecular weight and may be less mass efficient for the present purposes. Mono- and di-alkanolamines are preferred for mass efficiency reasons. Monoethanolamine is particularly preferred, however an additional alkanolamine, such as triethanolamine, can be useful in certain embodiments as a buffer. Moreover it is envisioned that in some embodiments of the invention, alkanolamine salts of anionic surfactants other than the aliquots used in the ESS can be added separately to the final detergent formulation, for example for known purposes such as solvency, buffering, the management of chlorine in wash liquors, and/or for enzyme stabilization in laundry detergent products.

c. Anionic Surfactant

Anionic surfactant may be present in the ESS of the present invention at any suitable weight percentage of the total system. Without wishing to be bound by theory, it is believed that the anionic surfactant acts as an emulsifier of melts of HCO and similarly crystallizable glycerides. In the context of the external structuring system only (as opposed to in the context of a liquid detergent composition comprising a surfactant system), the following is true. As used herein "anionic surfactant" in preferred embodiments does not include soaps and fatty acids; they may be present in the final laundry detergent compositions, but in general, other than limited amounts of 12-hydroxystearic acid which may arise from limited hydrolysis of hydrogenated castor oil glycerides, are not deliberately included in the ESS. For overall formula accounting purposes, "soaps" and "fatty acids" are accounted as builders. Otherwise, any suitable anionic surfactant is of use in the ESS of present invention.

Preferred anionic surfactants herein, especially for the ESS, possess what is termed "low Krafft temperatures". The term "Krafft temperature" as used herein is a term of art which is well-known to workers in the field of surfactant sciences. Krafft temperature is described by K. Shinoda in the text "Principles of Solution and Solubility", translation in collaboration with Paul Becher, published by Marcel Dekker, Inc. 1978 at pages 160-161. "Krafft temperature" for the present purposes is measured by taking the sodium salt of an anionic surfactant having a single chainlength; and measuring the clearing temperature of a 1 wt % solution of that surfactant. Alternative well-known art techniques include Differential Scanning calorimetry (DSC). See W. Kunz et al., Green Chem., 2008, Vol 10, pages 433-435. Preferred embodiments of the present invention external structuring systems employ anionic surfactants for which the corresponding sodium salt has a Krafft temperature below about 50° C., more preferably, below about 40° C., more preferably still, below about 30°, or below about 20°, or below 0° C.

Stated succinctly, the solubility of a surface active agent in water increases rather slowly with temperature up to that point, i.e., the Krafft temperature, at which the solubility evidences an extremely rapid rise. At a temperature of approximately 4° C. above the Krafft temperature, a surfactant solution of almost any soluble anionic surfactant becomes a single, homogeneous phase. In general, the Krafft temperature of any given type of anionic surfactant will vary with the chain length of the hydrocarbyl group; this is due to the change in water solubility with the variation in the hydrophobic portion of the surfactant molecule.

Under circumstances where the anionic surfactant herein comprises a mixture of alkyl chain lengths, the Krafft temperature will not be a single point but, rather, will be denoted as a "Krafft boundary". Such matters are well-known to those skilled in the science of surfactant/solution measurements. In any event, for such mixtures of anionic surfactants, what will be measured is the Krafft temperature of at least the longest chain-length surfactant present at a level of at least 10% by weight in such mixtures.

Krafft temperatures of single surfactant species are related to melting temperatures. The general intent herein, when using mixtures of anionic surfactants to emulsify hydrogenated castor oil or similarly crystallizable glycerides, is to obtain low melt temperatures of the collectivity of anionic surfactant molecules in the anionic surfactant mix.

A preferred group of anionic surfactants for inclusion in the ESS are synthetic anionic surfactants having a specified HI index, see the definition elsewhere in this specification. More particularly, for the ESS herein, it is preferred to use alkanolamine neutralized forms of a synthetic anionic non-soap surfactant for which the corresponding Na-salt of the anionic surfactant has HI below 8, preferably below 6, more preferably, below 5.

Without intending to be limited by theory, melting of anionic surfactant is majorly influenced by its hydrophobic group, while HI depends on a balanced ratio of hydrophilic and hydrophobic groups.

For example AE3S is undesirably hydrophilic for use in the ESS according to HI and has low Kraft point or melting temperature, which is desirable for use in the ESS premix; while LAS, especially LAS not having more than a limited amount of 2-phenyl isomers, is both desirably hydrophobic according to HI value for use in the ESS premix, and can be selected to have low melting temperatures (including molecules having low Krafft point), rendering its use preferred in the ESS premix. Note however, that when formulating the balance of the laundry detergent composition, it may be desirable in some embodiments to introduce separately from the ESS premix, an appreciable amount of AES-type surfactants for their known resistance to water hardness and good whiteness benefits.

In one embodiment the anionic surfactants used in the ESS can have pKa values of less than 7, although anionic surfactants having other pKa values may also be usable.

Non-limiting examples of suitable anionic surfactants of use herein include: Linear Alkyl Benzene Sulphonate (LAS), Alkyl Sulphates (AS), Alkyl Ethoxylated Sulphonates (AES), Laureth Sulfates and mixtures thereof. In some embodiments, the anionic surfactant may be present in the external structuring system at a level of from about 5% to about 50%. Note however, that when using more than about 25% by weight of the ESS of an anionic surfactant, it is typically required to thin the surfactant using an organic solvent in addition to water. Suitable solvents are listed hereinafter.

Further, when selecting the anionic surfactant for the ESS, and an alkylbenzene sulfonate surfactant is chosen for this purpose, it is preferred to use any of (1) alkylbenzene sulfonates selected from HF-process derived linear alkylbenzenes and/or (2) mid-branched LAS (having varying amounts of methyl side-chains—see for example U.S. Pat. No. 6,306,817, U.S. Pat. No. 6,589,927, U.S. Pat. No. 6,583,096, U.S. Pat. No. 6,602,840, U.S. Pat. No. 6,514,926, U.S. Pat. No. 6,593,285. Other preferred LAS sources include (3) those available from Cepsa LAB, see WO 09/071,709A1; and (4) those available from UOP LAB, see WO 08/055121A2. In contrast, LAS derived from DETAL™ process (UOP, LLC, Des Plaines, Ill.) process and/or LAS having high 2-phenyl content as taught by Huntsman (see for example U.S. Pat. No. 6,849,588 or US 2003/0096726A1 and having, for example, more than 70% or 80% 2-phenyl isomer content) are preferably avoided for use in the ESS, although they may be incorporated into the final laundry detergent compositions. Without intending to be limited by theory, excessive 2-phenyl isomer content leads to undesirably high melting temperatures of the LAS.

As noted previously, the anionic surfactant can be introduced into the ESS either as the acid form of the surfactant, and/or pre-neutralized with the alkanolamine. In no case is the anionic surfactant used as a sodium-neutralized form; more generally, the anionic surfactant is not used in the form of any monovalent or divalent inorganic cationic salt such as the sodium, potassium, lithium, magnesium, or calcium salts. Preferably, the ESS and the laundry detergents herein comprise less than about 5%, 2% or 1% of monovalent inorganic cations such as sodium or potassium. In a preferred embodiment, no (i.e., 0%) in total of monovalent and/or divalent inorganic metal ions whatsoever are added to the ESS, and no soap is deliberately added in making the ESS. In other words, the ESS is substantially free from monovalent and/or divalent inorganic metal ions.

d. Additional Components

1) Additional Anionic Surfactant

The ESS of the present invention may optionally contain surfactant in addition to anionic surfactants. In some embodiments, the systems may further comprise surfactant selected from: nonionic surfactant; cationic surfactant; amphoteric surfactant; zwitterionic surfactant; and mixtures thereof.

2) Buffer

The ESS of the invention may optionally contain a pH buffer. In some embodiments, the pH is maintained within the pH range of from about 5 to about 11, or from about 6 to about 9.5, or from about 7 to about 9. Without wishing to be bound by theory, it is believed that the buffer stabilizes the pH of the external structuring system thereby limiting any potential hydrolysis of the HCO structurant. However, buffer-free embodiments can be contemplated and when HCO hydrolyses, some 12-hydroxystearate may be formed, which has been described in the art as being capable of structuring. In certain preferred buffer-containing embodiments, the pH buffer does not introduce monovalent inorganic cations, such as sodium, in the structuring system. In some embodiments, the preferred buffer is the monethanolamine salt of boric acid. However embodiments are also contemplated in which the buffer is sodium-free and boron-free; or is free from any deliberately added sodium, boron or phosphorus. In some embodiments, the MEA neutralized boric acid may be present at a level of from about 0% to about 5%, from about 0.5% to about 3%, or from about 0.75% to about 1% by weight of the structuring system.

As already noted, alkanolamines such as triethanolamine and/or other amines can be used as buffers; provided that alkanolamine is first provided in an amount sufficient for the primary structurant emulsifying purpose of neutralizing the acid form of anionic surfactants.

3) Water

ESS of the present invention may contain water. Water may form the balance of the present structuring systems after the weight percentage of all of the other ingredients are taken into account.

In some embodiments, the water may be present at a level of from about 5% to about 90%, from about 10% to about 40%, or from about 15% to about 35% by weight of the external structuring system.

e. Optional Components

1) Preservative

Preservatives such as soluble preservatives may be added to the ESS or to the final detergent product so as to limit contamination by microorganisms. Such contamination can lead to colonies of bacteria and fungi capable of resulting in phase separation, unpleasant, e.g., rancid odors and the like. The use of a broad-spectrum preservative, which controls the growth of bacteria and fungi is preferred. Limited-spectrum preservatives, which are only effective on a single group of microorganisms may also be used, either in combination with a broad-spectrum material or in a "package" of limited-spectrum preservatives with additive activities. Depending on the circumstances of manufacturing and consumer use, it may also be desirable to use more than one broad-spectrum preservative to minimize the effects of any potential contamination.

The use of both biocidal materials, i.e. substances that kill or destroy bacteria and fungi, and biostatic preservatives, i.e. substances that regulate or retard the growth of microorganisms, may be indicated for this invention.

In order to minimize environmental waste and allow for the maximum window of formulation stability, it is preferred that preservatives that are effective at low levels be used. Typically, they will be used only at an effective amount. For the purposes of this disclosure, the term "effective amount" means a level sufficient to control microbial growth in the product for a specified period of time, i.e., two weeks, such that the stability and physical properties of it are not negatively affected. For most preservatives, an effective amount will be between about 0.00001% and about 0.5% of the total formula, based on weight. Obviously, however, the effective level will vary based on the material used, and one skilled in the art should be able to select an appropriate preservative and use level.

Preferred preservatives for the compositions of this invention include organic sulphur compounds, halogenated materials, cyclic organic nitrogen compounds, low molecular weight aldehydes, quaternary ammonium materials, dehydroacetic acid, phenyl and phenoxy compounds and mixtures thereof.

Examples of preferred preservatives for use in the compositions of the present invention include: a mixture of about 77% 5-chloro-2-methyl-4-isothiazolin-3-one and about 23% 2-methyl-4-isothiazolin-3-one, which is sold commercially as a 1.5% aqueous solution by Rohm & Haas (Philadelphia, Pa.) under the trade name Kathon; 1,2-benzisothiazolin-3-one, which is sold commercially by Avecia (Wilmington, Del.) as, for example, a 20% solution in dipropylene glycol sold under the trade name Proxel™ GXL sold by Arch Chemicals (Atlanta, Ga.); and a 95:5 mixture of 1,3 bis (hydroxymethyl)-5,5-dimethyl-2,4 imidazolidinedione and 3-butyl-2-iodopropynyl carbamate, which can be obtained, for example, as Glydant Plus from Lonza (Fair Lawn, N.J.). The preservatives described above are generally only used at an effective amount to give product stability. It is conceivable, however, that they could also be used at higher levels in the compositions on this invention to provide a biostatic or antibacterial effect on the treated articles. A highly preferred preservative system is sold commercially as Acticide™ MBS and comprises the actives methyl-4-isothiazoline (MIT) and 1,2-benzisothizolin-3-one (BIT) in approximately equal proportions by weight and at a total concentration in the Acticide™ MBS of about 5%. The Acticide is formulated at levels of about 0.001 to 0.1%, more typically 0.01 to 0.1% by weight on a 100% active basis in the ESS premix.

2) Solvent to Reduce Viscosity

In general the ESS herein comprises water, typically at levels of from 5% to 90%, preferably from 10% to 80%, more preferably from 30% to 70%. However organic non-aminofunctional organic solvents, typically consisting essentially of C, H and O (i.e., non-silicones and heteroatom-free) may also be present in the ESS as solvents to help control or reduce viscosity, especially during processing. The combination of water and non-aminofunctional organic solvent is sometimes referred to as a "liquid carrier".

Thus organic non-aminofunctional organic solvents may be present when preparing the ESS premixes, or in the final detergent composition. Preferred organic non-aminofunctional solvents include monohydric alcohols, dihydric alcohols, polyhydric alcohols, glycerol, glycols, polyalkylene glycols such as polyethylene glycol, and mixtures thereof. Highly preferred are mixtures of solvents, especially mixtures of lower aliphatic alcohols such as ethanol, propanol, butanol, isopropanol, and/or diols such as 1,2-propanediol or 1,3-propanediol; or mixtures thereof with glycerol. Suitable alcohols especially include a C1-C4 alcohol. Preferred is 1,2-propanediol or ethanol and mixtures thereof. The invention includes embodiments in which propanediols are used but methanol and ethanol are not used. In the final detergent compositions herein, liquid carrier is typically present at levels in the range of from about 0.1% to about 98%, preferably at least from about 10% to about 95%, more preferably from about 25% to about 75% by weight of the composition. In the ESS premixes, organic non-aminofunctional solvents may be present at levels of from 0 to about 30 weight %, more typically from 0 about 20 weight %, and in some embodiments from about 1 to about 5 weight %, of the ESS.

3) Other Thickeners

Polymeric thickeners known in the art, e.g., Carbopol™ from Lubrizol (Wickliffe, Ohio), acrylate copolymers such as those known as associative thickeners and the like may be used to supplement the ESS. These materials may be added either in the ESS premix, or separately into the final detergent composition. Additionally or alternatively known LMOG (low molecular weight organogellants) such as dibenzylidene sorbitol may be added to the compositions either in the ESS premix, or in the final detergent compositions. Suitable use levels are from about 0.01% to about 5%, or from about 0.1 to about 1% by weight of the final detergent composition.

4) Particulate Material

Either the ESS or the final detergent composition may further include particulate material such as suds suppressors, encapsulated sensitive ingredients, e.g., perfumes, bleaches and enzymes in encapsulated form; or aesthetic adjuncts such as pearlescent agents, pigment particles, mica or the like. Suitable use levels are from about 0.0001% to about 5%, or from about 0.1% to about 1% by weight of the final detergent composition. In embodiments of the invention it is found useful to incorporate certain particulate materials, e.g., mica for visual appearance benefits, directly into the ESS while formulating more sensitive particulate materials, e.g., encapsulated enzymes and/or bleaches, at a later point into the final detergent composition.

II. Method of Making External Structuring System

ESS of the present invention may be made using a method comprising the steps of: (a) preparing a first premix generally containing anionic surfactant and carrier fluid e.g., water and/or polyols; (b) forming a hot premix with inclusion of crystallizable glyceride(s) in the premix at a temperature of from about 50° C. to about 150° C.; (c) at least partially cooling or allowing to cool the product of steps (a) and (b) to provide the external structuring system (ESS) of the invention; and (d) optionally, adding a preservative to the external structuring system. These steps may be completed in the following order: "a" through "d". However, it is noted that variations which result in thread-like ESS are also meant to be encompassed within the present invention, for example preservative may be included in step (a) rather than as a separate step (d). Each of the steps is discussed below. Once the ESS has been prepared, it may added to the balance of the detergent composition, typically with a temperature difference of no more than 20° C. to 30° C. between the ESS and the balance of the detergent composition; preferably the ESS and balance of the detergent are combined in the cold.

a. Preparing a Premix

In this step, a premix is made. In some embodiments, the premix comprises all of the components that are present in the external structuring system. Thus, the premix may be made by combining crystallizable glyceride(s); alkanolamine; anionic surfactant; water; lower alcohols; glycols; and any optional ingredient(s). Non-limiting examples of optional ingredients include preservatives, buffers surfactants other than the aforementioned anionic surfactant, aesthetic adjuncts such as perfumes or colorants, and the like.

b. Emulsifying the HC

In this step, the crystallizable glyceride(s) in the premix is emulsified, forming an emulsion, a mixture of an emulsion and a microemulsion, or a microemulsion. It is preferred to form an emulsion, for reasons set forth hereinbefore.

This may be accomplished by increasing the temperature of the premix and/or by energy dissipation through the premix.

The temperature may be increased using heat of neutralization of the anionic surfactant acid form on mixing with the alkanolamine; and/or through the application of heat from an external source.

The premix is heated to a temperature above room temperature. In some embodiments, the premix is heated to above the melting point of the crystallizable glyceride structuring agent, such as HCO for example. In some embodiments, the premix is heated to a temperature of from about 50° C. to about 150° C., or from about 75° C. to about 125° C., or from about 80° C. to about 95° C.

With energy dissipation, it is understood that any kind of device, delivering energy input to the premix can be applied to form the emulsion. Non-limiting examples of such devices may be selected from: static mixers and dynamic mixers (including all kinds of low shear and high shear mixers. In some embodiments, the emulsion can be formed in batch making system or in a semi continuous making system or a continuous making system.

c. Cooling the Premix

In this step, the premix is then cooled. Without wishing to be bound by theory, it is believed that during cooling, the liquid oil emulsion droplets de-wet as a result of surfactant adsorption, thereby promoting crystallization. Small crystals may nucleate from around the emulsion droplets during cooling. It is further believed that crystallization may be influenced by surfactant adsorption or cooling rate.

In some embodiments of the present invention, the external structuring system is cooled at a cooling rate of from about 0.1° C./min to about 10° C./min, from about 0.5° C./min to about 1.5° C./min, or from about 0.8° C./min to about 1.2° C./min.

d. Addition of Preservative

As an optional step, at any point in the process sequence, a preservative as described hereinabove can be added to the embodiment. This can for example be useful if the premix is to be stored or shipped and needs to remain microbially uncontaminated over time.

General Shear Conditions

As has already been pointed out, the ESS herein can be manufactured using a range of equipment types and shear regimes. In one preferred embodiment, the process employs a relatively low shear regime, in which shear rates reach a maximum of from 100 to 500 $s^{-1}$, and the ESS experiences this shear maximum for a residence time under the highest shear condition of no more than 60 to 100 seconds (s). In practical terms, one process employs batch, pipe, pump and plate heat exchanger devices, and the maximum shear occurs in the plate heat exchanger stage used to cool the ESS; but the ESS passes quite seldom through this high shear area, for example only from about three to about five passes per production run.

III. Detergent Compositions

The ESS of the present invention may be incorporated into a detergent composition or components thereof as described below. The detergent composition can take any suitable form and may be selected from liquid laundry detergent, unit dose detergent and/or hard surface cleaning compositions.

a. Method of Incorporating the External Structuring System

Any suitable means of incorporating the ESS of the present invention into a detergent composition or components thereof may be utilized. One of skill in the art is capable of determining at what point in the detergent manufacturing process that the ESS should be incorporated. Since ESS of the present invention may be shear sensitive, it may be desirable in some embodiments to add the ESS to the detergent composition or components of thereof as late in the manufacturing process as possible. However, in some embodiments, it may be desirable to add the ESS earlier in the manufacturing process to stabilize any non-homogeneity prior to finishing the detergent in a late product differentiation process. Thus in some embodiments, the systems may be added via a continuous liquid process, whereas in other embodiments, the systems may be added via late product differentiation.

When incorporating ESS that are shear sensitive into other components to form a detergent composition, it may be advantageous to set certain operating parameters. For example, in some embodiments, the average shear rate utilized to incorporate the ESS may be from about 300 $s^{-1}$ to about 500 $s^{-1}$, from about 100 $s^{-1}$ to about 5000 $s^{-1}$, or from about 0.01 $s^{-1}$ to about 10000 $s^{-1}$. Instantaneous shear may be as high as from about 3000 $s^{-1}$ to about 5000 $s^{-1}$ for a short period of time. To define the rheology profile, a TA550 Rheometer, available from TA Instruments, is used to determine the flow curve of the compositions. The determination is performed at 20° C. with a 4 cm flat plate measuring system set with a 500 micron gap. The determination is performed via programmed application of a shear rate continuous ramp (typically 0.05 $s^{-1}$ to 30 $s^{-1}$) over a period of time (3 minutes). These data are used to create a viscosity versus shear rate flow curve.

The time needed to incorporate ESS into other components to form a detergent composition may be from about from about 1 s to about 120 s, from about 0.5 s to about 1200 s or from about 0.001 s to about 12000 s.

b. Liquid Laundry Detergent Compositions

In some embodiments, the present invention is directed to liquid laundry detergent compositions comprising the ESS of the present invention. The liquid laundry detergent compositions may be in any suitable form and may comprise any suitable components. Non-limiting examples of suitable components are described in turn below.

1) Surfactant Component

The detergent compositions herein comprise from about 1% to 70% by weight of a surfactant component selected from anionic, nonionic, cationic, zwitterionic and/or amphoteric surface active agents. More preferably, the surfactant component will comprise from about 5% to 45% by weight of the composition and will comprise anionic surfactants, nonionic surfactants and combinations thereof. Non-limiting examples of useful surfactant materials are described as follows:

i) Anionic Surfactants

Suitable anionic surfactants useful herein can comprise any of the conventional anionic surfactant types typically used in liquid detergent products. These include the alkyl benzene sulfonic acids and their salts as well as alkoxylated or un-alkoxylated alkyl sulfate materials.

Preferred anionic surfactants are the alkali metal salts of C10-16 alkyl benzene sulfonic acids, preferably C11-14 alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium C11-C14, e.g., C12, LAS is especially preferred.

Another preferred type of anionic surfactant comprises ethoxylated alkyl sulfate surfactants. Such materials, also known as alkyl ether sulfates or alkyl polyethoxylate sulfates, are those which correspond to the formula:

R'—O—(C2H4O)*n*-SO3M wherein R' is a C8-C20 alkyl group, n is from about 1 to 20, and M is a salt-forming cation. Preferably, R' is C10-C18 alkyl, n is from about 1 to 15, and M is sodium, potassium, ammonium, alkylammonium, or alkanolammonium. Most preferably, R' is a C12-C16, n is from about 1 to 6 and M is sodium.

The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the compositions of this invention and used as or in any anionic surfactant component which may be present.

Preferred unalkoyxylated, e.g., unethoxylated, alkyl ether sulfate surfactants are those produced by the sulfation of higher C8-C20 fatty alcohols. Conventional primary alkyl sulfate surfactants have the general formula:

ROSO3-M+ wherein R is typically a linear C8-C20 hydrocarbyl group, which may be straight chain or branched chain, and M is a water-solubilizing cation. Preferably R is a C10-C15 alkyl, and M is alkali metal. Most preferably R is C12-C14 and M is sodium.

ii) Nonionic Surfactants

Suitable nonionic surfactants useful herein can comprise any of the conventional nonionic surfactant types typically used in liquid detergent products. These include alkoxylated fatty alcohols and amine oxide surfactants. Preferred for use in the liquid detergent products herein are those nonionic surfactants which are normally liquid.

Preferred nonionic surfactants for use herein include the alcohol alkoxylate nonionic surfactants. Alcohol alkoxylates are materials which correspond to the general formula:

R1(CmH2*m*O)*n*OH wherein R1 is a C8-C16 alkyl group, m is from 2 to 4, and n ranges from about 2 to 12. Preferably R1 is an alkyl group, which may be primary or secondary, which contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the tradenames Neodol™ and Dobanol™ by the Shell Chemical Company (Houston, Tex.).

Another suitable type of nonionic surfactant useful herein comprises the amine oxide surfactants. Amine oxides are materials which are often referred to in the art as "semi-polar" nonionics. Amine oxides have the formula: R(EO)x(PO)y(BO)zN(O)(CH2R')$_2$.qH2O. In this formula, R is a relatively long-chain hydrocarbyl moiety which can be saturated or unsaturated, linear or branched, and can contain from 8 to 20, preferably from 10 to 16 carbon atoms, and is more preferably C12-C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by C12-14 alkyldimethyl amine oxide.

iii) Anionic/Nonionic Surfactant Combinations

In the liquid detergent compositions herein, the detersive surfactant component may comprise combinations of anionic and nonionic surfactant materials.

2) Aqueous Liquid Carrier

Generally the amount of the aqueous, non-surface active liquid carrier employed in the compositions herein will be relatively large. For example, the non-aqueous, non-surface active liquid carrier component can comprise from about 0% to 40% by weight of the compositions herein. More preferably this liquid carrier component will comprise from about 1% to 30%, and even more preferably from 2% to 25% by weight of the compositions herein.

The most cost effective type of aqueous, non-surface active liquid carrier is, of course, water itself. Accordingly, the aqueous, non-surface active liquid carrier component will generally be mostly, if not completely, comprised of water. While other types of water-miscible liquids, such alkanols, diols, other polyols, ethers, amines, and the like, have been conventionally been added to liquid detergent compositions as co-solvents or stabilizers, for purposes of the present invention, the utilization of such water-miscible liquids should be minimized to hold down composition cost. Accordingly, the aqueous liquid carrier component of the liquid detergent products herein will generally comprise water present in concentrations ranging from about 0% to 90%, more preferably from about 5% to 70%, by weight of the composition.

3) Optional Detergent Composition Ingredients

The detergent compositions of the present invention can also include any number of additional optional ingredients. These include conventional laundry detergent composition components such as detersive builders, enzymes, enzyme stabilizers (such as propylene glycol, boric acid and/or borax), suds suppressors, soil suspending agents, soil release agents, other fabric care benefit agents, pH adjusting agents, chelating agents, smectite clays, solvents, hydrotropes and phase stabilizers, structuring agents, dye transfer inhibiting agents, optical brighteners, perfumes and coloring agents. The various optional detergent composition ingredients, if present in the compositions herein, should be utilized at concentrations conventionally employed to bring about their desired contribution to the composition or the laundering operation. Frequently, the total amount of such optional detergent composition ingredients can range from 2% to 50%, more preferably from 5% to 30%, by weight of the composition. A few of the optional ingredients which can be used are described in greater detail as follows:

i) Organic Detergent Builders

The detergent compositions herein may also optionally contain low levels of an organic detergent builder material which serves to counteract the effects of calcium, or other ion, water hardness encountered during laundering/bleaching use of the compositions herein. Examples of such materials include the alkali metal, citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids C10-C22 fatty acids and citric acid. Other examples are organic phosphonate type sequestering agents such as those which have been sold by Monsanto under the Dequest tradename and alkanehydroxy phosphonates. Citrate salts and C12-C18 fatty acid soaps are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark.

If utilized, organic builder materials will generally comprise from about 1% to 50%, more preferably from about 2% to 30%, most preferably from about 5% to 20%, by weight of the composition.

ii) Detersive Enzymes

The liquid detergent compositions herein may comprise one or more detersive enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, lignin-nases, pullulanases, tannases, pentosanases, malanases, β-glucanases, arabinosidases, hyaluronidase, chondroitinase, laccase, and known amylases, or combinations thereof. A preferred enzyme combination comprises a cocktail of conventional detersive enzymes like protease, lipase, cutinase and/or cellulase in conjunction with amylase. Detersive enzymes are described in greater detail in U.S. Pat. No. 6,579,839.

If employed, enzymes will normally be incorporated into the liquid detergent compositions herein at levels sufficient to provide up to 3 mg by weight, more typically from about 0.0001 mg to about 2.5 mg, of active enzyme per gram of the composition. Stated otherwise, the aqueous liquid detergent compositions herein can typically comprise from 0.001% to 5%, preferably from 0.005% to 3% by weight, of a commercial enzyme preparation. The activity of the commercial enzyme preparation is typically in the range of 10 to 50 mg active enzyme protein per gram of raw material.

iii) Solvents, Hydrotropes and Phase Stabilizers

The detergent compositions herein may also optionally contain low levels of materials which serve as phase stabilizers and/or co-solvents for the liquid compositions herein. Materials of this type include C1-C3 lower alkanols such as methanol, ethanol and/or propanol. Lower C1-C3 alkanolamines such as mono-, di- and triethanolamines can also be used, by themselves or in combination with the lower alkanols. If utilized, phase stabilizers/co-solvents can comprise from about 0.1% to 5.0% by weight of the compositions herein.

iv) pH Control Agents

The detergent compositions herein may also optionally contain low levels of materials which serve to adjust or maintain the pH of the aqueous detergent compositions herein at optimum levels. The pH of the compositions of this invention should range from about 6.0 to about 10.5, from about 7.0 to about 10.0, or from about 8.0 to about 8.5. Materials such as NaOH can be added to alter composition pH, if necessary.

c. Unit Dose Detergent

In some embodiments of the present invention, the liquid detergent compositions are packaged in a unit dose pouch, wherein the pouch is made of a water soluble film material, such as a polyvinyl alcohol. In some embodiments, the unit dose pouch comprises a single or multi-compartment pouch where the present liquid detergent composition can be used in conjunction with any other conventional powder or liquid detergent composition. Examples of suitable pouches and water soluble film materials are provided in U.S. Pat. Nos. 6,881,713, 6,815,410, and 7,125,828. The pouch is preferably made of a film material which is soluble or dispersible in water, and has a water-solubility of at least 50%, preferably at least 75% or even at least 95%, as measured by the method set out here after using a glass-filter with a maximum pore size of 20 microns:

50 grams±0.1 gram of pouch material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred pouch materials are polymeric materials, preferably polymers which are formed into a film or sheet. The pouch material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatin, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Naturally, different film material and/or films of different thickness may be employed in making the compartments of the present invention. A benefit in selecting different films is that the resulting compartments may exhibit different solubility or release characteristics.

Most preferred pouch materials are PVA films known under the trade reference MonoSol M8630, as sold by Chris-Craft Industrial Products (Gary, Ind.), and PVA films of corresponding solubility and deformability characteristics. Other films suitable for use herein include films known under the trade reference PT film or the K-series of films supplied by Aicello (Koshikawa, Japan), or VF-HP film supplied by Kuraray (Tokyo, Japan).

The pouch material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

For reasons of deformability pouches or pouch compartments containing a component which is liquid will preferably contain an air bubble having a volume of up to about 50%, preferably up to about 40%, more preferably up to about 30%, more preferably up to about 20%, more preferably up to about 10% of the volume space of said compartment.

Unit dose pouches comprising liquid detergent compositions according to the present invention may be made using any suitable means. Non-limiting examples of such means are described in the patents listed above.

The pouch is preferably made of a film material which is soluble or dispersible in water, and has a water-solubility of at least 50%, preferably at least 75% or even at least 95%, as measured by the method set out here after using a glass-filter with a maximum pore size of 20 microns:

50 grams±0.1 gram of pouch material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). The percentage solubility or dispersability can then be calculated.

d. Hard Surface Cleaning Compositions

In some embodiments, the ESS may be utilized in liquid hard surface cleaning compositions. Such compositions include, but are not limited to, forms selected from gels, pastes, thickened liquid compositions as well as compositions having a water-like viscosity. A preferred liquid hard surface cleaning composition herein is an aqueous, liquid hard surface cleaning composition and therefore, preferably comprises water more preferably in an amount of from 50% to 98%, even more preferably of from 75% to 97% and most preferably 80% to 97% by weight of the total composition.

V. Examples

Referencing Tables I through III below, the non-limiting examples disclosed therein include those that are illustrative of several embodiments of the invention as well as those that are comparative.

Referencing Table I, Example 1 is a comparative example of a liquid detergent composition wherein a premix comprising 4% HCO, 16% Linear Alkyl Benzene Sulfonic acid neutralized by 1.9% NaOH and water up to 100 parts is made and then added at 18.75% level in a HDL matrix comprising the rest of the ingredients, to give the detergent composition 1 in Table I.

Referencing Table I, Example 2 is an example of a liquid detergent composition according to the invention, wherein a premix comprising 4% HCO, 16% Linear Alkylbenzene Sulfonic acid neutralized by 3.1% Monoethanolamine (MEA), and water up to 100 parts is made and then added at 18.75% in a HDL comprising the rest of the ingredients, to give the detergent composition 2 in Table I.

Referencing Table I, Examples 3 and 4 are examples of liquid detergent compositions according to the invention, using the same HCO premix with MEA neutralized Linear Alkylbenzene Sulfonic acid as in Example 2, added at the same level (18.75%) to the rest of the ingredients.

TABLE I

| Ingredient | Liquid Detergent Compositions | | | |
|---|---|---|---|---|
| | Example 1 (Comparative) % | Example 2 (Invention) % | Example 3 (Invention) % | Example 4 (Invention) % |
| Linear Alkylbenzene sulfonic acid[1] | 15 | 15 | 12 | 12 |
| C12-14 alkyl ethoxy 3 sulfate MEA salt | 10 | 10 | 8 | 9 |
| C12-14 alkyl 7-ethoxylate | 10 | 10 | 8 | 8 |
| C14-15 alkyl 8-ethoxylate | — | — | — | — |
| C12-18 Fatty acid | 10 | 10 | 10 | 10 |
| Citric acid | 2 | 2 | 3 | 3 |
| Ethoxysulfated Hexamethylene Diamine Dimethyl Quat | — | — | — | 2.2 |
| Soil Suspending Alkoxylated Polyalkylenimine Polymer[2] | 3 | 3 | 2.2 | — |
| PEG-PVAc Polymer[3] | — | — | 0.9 | 0.9 |
| Hydroxyethane diphosphonic acid | 1.6 | 1.6 | 1.6 | 1.6 |
| Fluorescent Whitening Agent | 0.2 | 0.2 | 0.2 | 0.2 |
| 1,2 Propanediol | 6.2 | 6.2 | 8.5 | 8.5 |
| Ethanol | 1.5 | 1.5 | — | — |
| Hydrogenated castor oil derivative structurant | 0.75 (introduced via NaLAS premix) | 0.75 (introduced via MEA LAS premix) | | |
| Boric acid | 0.5 | 0.5 | 0.5 | 0.5 |
| Perfume | 1.7 | 1.7 | 1.7 | 1.7 |
| Monoethanolamine | | To pH 8.0 | | |
| Protease enzyme | 1.5 | 1.5 | 1.5 | 1.5 |
| Amylase enzyme | 0.1 | 0.1 | 0.1 | 0.1 |
| Mannanase enzyme | 0.1 | 0.1 | 0.1 | 0.1 |
| Cellulase enzyme | — | — | 0.1 | 0.1 |
| Xyloglucanase enzyme | — | — | 0.1 | 0.1 |
| Pectate lyase | — | — | 0.1 | 0.1 |
| Water and minors (antifoam, aesthetics, . . . ) | | To 100 parts | | |

[1]Weight percentage of Linear Alkylbenzene sulfonic acid includes that which added to the composition via the premix

[2]600 g/mol molecular weight polyethylenimine core with 20 ethoxylate groups per —NH.

[3]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

The homogeneous visual appearance after 3 months storage at room temperature is better for Example 2 than for the comparative Example 1.

The liquid detergent compositions made according to Examples 2, 3 and 4 may be packaged into inverted squeezable bottles with slit valves.

Referencing Table II, Examples 5, 6 and 7 are also illustrative of liquid detergent compositions of the present invention. The liquid detergent compositions are prepared using the same premix comprising 4% HCO, 16% Linear Alkyl Benzene Sulfonic acid neutralized by 3.7% MEA and water up to 100 parts.

The premix is added to the rest of the formulae at a level of 13.07% (Example 5), 9.25% (Example 6) and 3.50% (Example 7) to provide the liquid detergent compositions described below in Table II.

TABLE II

| Ingredient | Detergent compositions | | |
|---|---|---|---|
| | Example 5 (Invention) % | Example 6 (Invention) % | Example 7 (Invention) % |
| Linear Alkylbenzene sulfonic acid[1] | 5.9 | 9 | 24 |
| C12-14 alkyl ethoxy 3 sulfate sodium salt | 2 | 3 | — |

TABLE II-continued

| Ingredient | Detergent compositions | | |
|---|---|---|---|
| | Example 5 (Invention) % | Example 6 (Invention) % | Example 7 (Invention) % |
| C12-14 alkyl 7-ethoxylate | 2 | 3.4 | 19 |
| C14-15 alkyl 8-ethoxylate | 2 | 3 | — |
| C12-18 Fatty acid | 2.5 | 4 | 11 |
| Citric acid | 2.5 | 3.5 | 0.6 |
| Ethoxysulfated Hexamethylene Diamine Dimethyl Quat | 1.5 | 2.2 | 3 |
| Soil Suspending Alkoxylated Polyalkylenimine Polymer[2] | — | — | 1.2 |
| PEG-PVAc Polymer[3] | — | — | |
| Hydroxyethane diphosphonic acid | — | — | 1.2 |
| Di Ethylene Triamine Penta (Methylene Phosphonic acid) | 0.2 | 0.3 | — |
| Fluorescent Whitening Agent | 0.1 | 0.1 | 0.25 |
| 1,2 Propanediol | 1 | 2 | 13 |
| Glycerol | — | — | 6 |
| Ethanol | 2 | 1.5 | — |
| Sodium cumene sulfonate | — | 1 | — |
| Potassium sulfite | — | — | 0.2 |
| Hydrogenated castor oil structurant | 0.5 | 0.37 | 0.14 |
| Boric acid | 1.3 | 2.4 | — |
| Perfume | 0.52 | 0.7 | 1.6 |

TABLE II-continued

| Ingredient | Detergent compositions Example 5 (Invention) % | Example 6 (Invention) % | Example 7 (Invention) % |
|---|---|---|---|
| Monoethanolamine | 0.9 | 1.2 | 8.8 (to pH 7.5) |
| NaOH to pH | pH 8.2 | pH 8.2 | — |
| Protease enzyme | 0.4 | 0.6 | 1.4 |
| Amylase enzyme | 0.1 | 0.2 | 0.2 |
| Mannanase enzyme | 0.1 | 0.1 | 0.1 |
| Cellulase enzyme | — | 0.1 | — |
| Xyloglucanase enzyme | — | — | 0.05 |
| Pectate lyase | 0.01 | 0.01 | — |
| Water and minors (antifoam, aesthetics, . . . ) | | To 100 parts | |

[1]Weight percentage of Linear Alkylbenzene sulfonic acid includes that which added to the composition via the premix

[2]600 g/mol molecular weight polyethylenimine core with 20 ethoxylate groups per —NH.

[3]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

The liquid detergent compositions made according to Examples 5, 6 and 7 may be packaged into inverted squeezable bottles with slit valves.

Referencing Table III, Example 8 is a comparative example of a Unit Dose soluble pouch detergent composition wherein a premix comprising 4% HCO, 16% Linear Alkyl Benzene Sulfonic acid neutralized by 1.9% NaOH, phosphate to buffer to pH=7.5 and water up to 100 parts is made and then added at 2.5% level in the detergent matrix comprising the rest of the ingredients, to give the detergent composition 1 in Table III.

Referencing Table III, Example 9 is another comparative example of a Unit Dose soluble pouch detergent composition wherein a premix comprising 4% HCO, 16% Linear Alkylbenzene Sulfonic acid neutralized by 1.9% NaOH, TEA to buffer to pH=7.5 and water up to 100 parts is made and then added at 2.5% in the detergent matrix comprising the rest of the ingredients, to give the detergent composition 2 in Table III.

Referencing Table III, Example 10 is an example of a Unit Dose soluble pouch detergent composition according to the invention, wherein a premix comprising 4% HCO, 16% Linear Alkylbenzene Sulfonic acid neutralized by Monoethanolamine (MEA), TEA to buffer to pH of 7.5 and water up to 100 parts is made and then added at 2.5% in the detergent matrix comprising the rest of the ingredients, to give the detergent composition 3 in Table III.

Referencing Table III, Example 11 is an example of a Unit Dose soluble pouch detergent composition according to the invention, wherein a premix comprising 4% HCO, 16% Linear Alkylbenzene Sulfonic acid neutralized by Monoethanolamine (MEA) with no added buffer, and water up to 100 parts is made and then added at 2.5% in a HDL comprising the rest of the ingredients, to give the detergent composition 3 in Table III.

TABLE III

| Ingredient | Unit Dose Detergent Compositions Example 8 (Comparative) % | Example 9 (Comparative) % | Example 10 (Invention) % | Example 11 (Invention) % |
|---|---|---|---|---|
| Linear Alkylbenzene sulfonic acid[1] | 15 | 15 | 15 | 17 |
| C12-14 alkyl ethoxy 3 sulfate MEA salt | 10 | 10 | 10 | 13 |
| C12-14 alkyl 7-ethoxylate | 13 | 13 | 13 | 15 |
| C14-15 alkyl 8-ethoxylate | — | — | — | — |
| C12-18 Fatty acid | 15 | 15 | 15 | 12 |
| Citric acid | 1 | 2 | 2 | 2 |
| Polydimethylsilicone | — | — | — | 2 |
| Soil Suspending Alkoxylated Polyalkylenimine Polymer[2] | 3 | 3 | 3 | — |
| Hydroxyethane diphosphonic acid | 1.2 | 1.6 | 1.6 | 1.6 |
| Fluorescent Whitening Agent | 0.2 | 0.2 | 0.2 | 0.4 |
| 1,2 Propanediol | 16 | 16 | 16 | 13 |
| Glycerol | 6 | 6 | 6 | 10 |
| Hydrogenated castor oil derivative structurant | 0.10 (introduced via NaLAS premix) | 0.10 (introduced via NaLAS premix) | 0.10 (introduced via MEA LAS premix) | 0.2 (introduced via MEA LAS premix) |
| Phosphate | 60 ppm (introduced via NaLAS premix) | | | |
| Triethanolamine | | 60 ppm (introduced via MEA LAS premix) | 60 ppm (introduced via MEA LAS premix) | |
| Perfume | 2.0 | 2.0 | 2.0 | 2.0 |
| Monoethanolamine | | To pH 8.0 | | |
| Protease enzyme | 1.5 | 1.5 | 1.5 | 1.5 |
| Amylase enzyme | 0.1 | 0.1 | 0.1 | |
| Mannanase enzyme | 0.1 | 0.1 | 0.1 | |
| Water and minors (antifoam, aesthetics, stabilizers, . . . ) | | To 100 parts | | |

[1]Weight percentage of Linear Alkylbenzene sulfonic acid includes that which added to the composition via the premix

[2]600 g/mol molecular weight polyethylenimine core with 20 ethoxylate groups per —NH.

VI. Comparative Data

The present figures relate to rheological characterization of an external structurant system of the invention compared to a conventional (Na-LAS emulsified) hydrogenated castor oil external structurant.

In each of the Figures, a comparison is made of the rheology for an identical level of 9.25% parts by weight of the external structurant (ESS) premix, delivering a total of 0.37% by weight of hydrogenated castor oil structurant, in a concentrated liquid laundry detergent of Example 6. The comparisons are made with an otherwise identical formula which substitutes hydrogenated castor oil which has been emulsified in the premix using Na-neutralized LAS, in other words, an external structurant system of the art. The rheological data demonstrates a substantial improvement in thickening by the inventive external structurant.

The inventive external structurant, as incorporated in liquid detergent exhibits a relatively high viscosity at low shear, and a relatively low viscosity at high shear and is highly shear thinning.

To define the rheology profile, a TA550 Rheometer, available from TA Instruments, is used to determine the flow curve of the compositions. The determination is performed at 20° C. with a 4 cm flat plate measuring system set with a 500 micron gap. The determination is performed via programmed application of a shear rate continuous ramp (typically 0.05 $s^{-1}$ to 30 $s^{-1}$) over a period of time (3 minutes).

These data are used to create a viscosity versus shear rate flow curve.

FIG. 1 is the resulting plot comparison in the range 0 to 30 $s^{-1}$, showing viscosity (Pa·s) on log scale on the vertical axis vs. shear rate ($s^{-1}$) on the horizontal axis.

Figure 2:
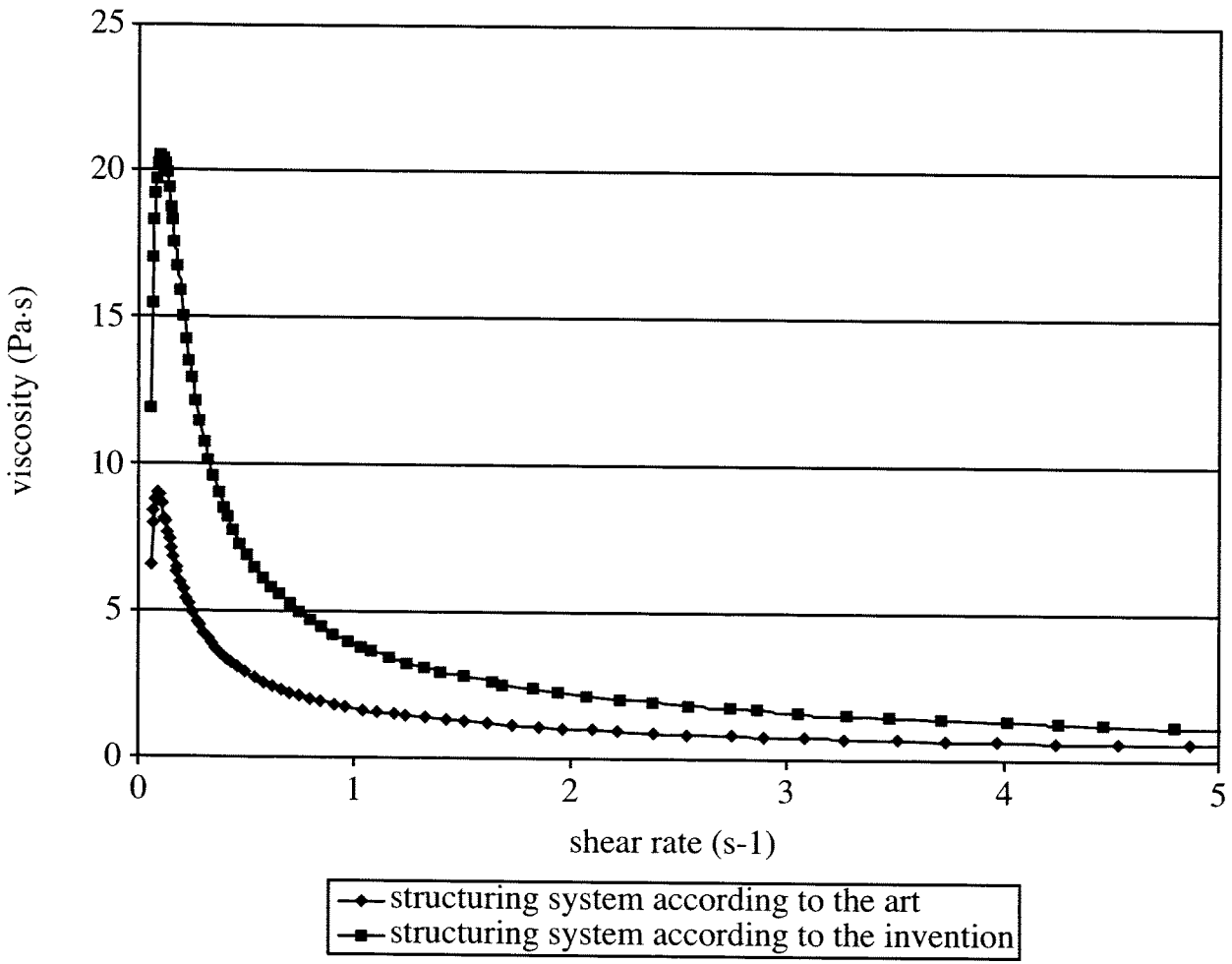
FIG. 2 is a plot comparison of viscosity vs. shear rate in the range of 0 to 5 $s^{-1}$.

FIG. 2 is the resulting plot comparison in the range 0 to 5 $s^{-1}$, showing viscosity (Pa·s) on linear scale on the vertical axis vs. shear rate ($s^{-1}$) on the horizontal axis.

Figure 3:
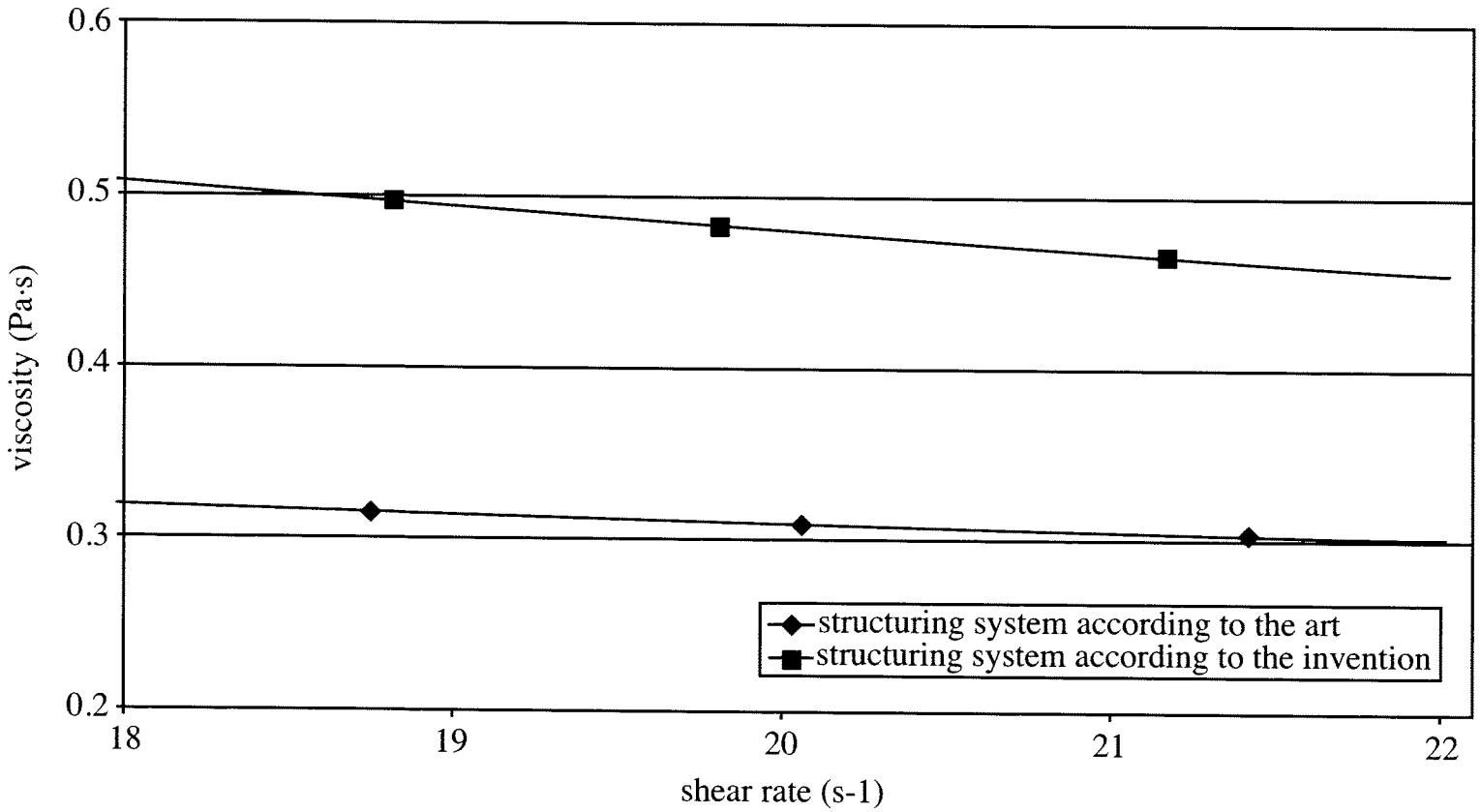
FIG. 3 is a plot comparison of pour viscosity (measured at 20 $s^{-1}$) vs. shear rate.

FIG. 3 is the resulting plot comparison for pour viscosity measured at 20 $s^{-1}$, showing viscosity (Pa·s) on linear scale on the vertical axis vs. shear rate ($s^{-1}$) on the horizontal axis.

In all three plots the superiority of the inventive system is evident. Further, these results are consistent with microscopic examination of the ESS and of detergents containing it, which demonstrate a superior uniform dispersion of threadlike or rod-like structures of crystallized hydrogenated castor oil as compared to Na-LAS emulsified analogs.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An external structuring system for liquid and gel-form laundry detergents comprising by weight percentage:

a. from about 2 to about 10% of crystals of a glyceride which is hydrogenated castor oil having a melting temperature of from 40° C. to 100° C.;

b. from about 2 to about 10% of an alkanolamine, wherein said alkanolamine is monoethanolamine; and c. from about 5 to about 50% of the anion of an alkylbenzene sulfonate anionic surfactant;

wherein said alkanolamine is present in an amount at least balancing the charge of the anion form of said anionic alkylbenzene sulfonate surfactant;

wherein said structuring system is substantially free from monovalent and divalent inorganic metal ions;

wherein the external structuring system is free of nonionic surfactant;

wherein the external structuring system is free from soap and fatty acids;

wherein the external structuring system is boron-free; and wherein the external structuring system further comprises from 30% to 90% water.

2. The external structuring system according to claim 1, wherein said crystals have a non-spherical elongated crystal habit with an aspect ratio of at least 5:1 and a needle radius of at least about 20 nanometers.

3. The external structuring system according to claim 1, wherein said alkylbenzene sulfonate has a 2-phenyl isomer content of not more than 70%.

4. The external structuring system according to claim 1 wherein said alkanolamine is present in said structuring system in stoichiometric excess over said anionic surfactant and the pH on dilution at 5 weight % in water of said external structuring system is from about 7.5 to about 9.0.

5. The external structuring system according to claim 1, comprising from 12% to about 50% of the anion of the alkylbenzene sulfonate anionic surfactant.

6. The external structuring system according to claim 1, further comprising from 30% to 90%, by weight of the composition, water.

7. An external structuring system for liquid and gel-form laundry detergents comprising by weight percentage:

a. from about 2 to about 10% of crystals of a glyceride which is hydrogenated castor oil having a melting temperature of from 40° C. to 100° C.;

b. from about 2 to about 10% of an alkanolamine, wherein said alkanolamine is monoethanolamine; and c. from about 5 to about 50% of an alkylbenzene sulfonate anionic surfactant;

wherein said anionic surfactant is preneutralized by said alkanolamine;

wherein said external structuring system is free from soap and fatty acids; and wherein said structuring system is substantially free from monovalent and divalent inorganic metal ions.

8. An external structuring system for liquid and gel-form laundry detergents consisting essentially of by weight percentage:

a. from about 2 to about 10% of crystals of a glyceride which is hydrogenated castor oil having a melting temperature of from 40° C. to 100° C.;

b. from about 2 to about 10% of an alkanolamine; and c. from about 5 to about 50% of an anionic surfactant; and d. water.

9. The external structuring system of claim 8, wherein said external structuring system is free from soap and fatty acids.

* * * * *